United States Patent [19]

Barwick et al.

[11] 4,284,438

[45] Aug. 18, 1981

[54] MANUFACTURE OF STEEL PRODUCTS

[75] Inventors: Donald Barwick, Ormesby; Malcolm Brownlee, Middlesbrough, England

[73] Assignee: British Steel Corporation, England

[21] Appl. No.: 93,227

[22] Filed: Nov. 13, 1979

Related U.S. Application Data

[63] Continuation-in-part of Ser. No. 917,272, Jun. 20, 1978, abandoned.

[30] Foreign Application Priority Data

Jun. 20, 1977 [GB] United Kingdom ..... 25695/77

[51] Int. Cl.[3] ..... C21D 1/25; C21D 8/08

[52] U.S. Cl. ..... 148/12 B; 148/39

[58] Field of Search ..... 148/12 B, 12.4, 156, 148/39, 134, 145, 153, 157

[56] References Cited

U.S. PATENT DOCUMENTS

| | | | |
|---|---|---|---|
| 3,231,432 | 1/1966 | McLean et al. | 148/12 B |
| 3,666,572 | 5/1972 | Nakagawa et al. | 148/12.4 |
| 3,756,870 | 9/1973 | Kasper et al. | 148/12.4 |
| 3,810,793 | 5/1974 | Heller | 148/12 B |
| 3,939,015 | 2/1976 | Grange | 148/12 B |
| 4,016,009 | 4/1977 | Economopoulos et al. | 148/156 |
| 4,016,015 | 4/1977 | Respen et al. | 148/156 |
| 4,108,695 | 8/1978 | Paulitsch et al. | 148/39 |

FOREIGN PATENT DOCUMENTS

| | | | |
|---|---|---|---|
| 2345738 | 2/1977 | Fed. Rep. of Germany | 148/39 |

*Primary Examiner*—Peter K. Skiff

*Attorney, Agent, or Firm*—Bacon & Thomas

[57] ABSTRACT

A process for the production of a high strength steel rod or bar which is capable of being substantially cold drawn without any intermediate heat treatment. The steel is hot rolled in a continuous rolling mill and exits from the last stand at a temperature greater than 1000° C. It is then cooled in water to an equalization temperature of between 300° C. and 700° C., and is immediately layed in flat overlapping non-concentric rings on a moving conveyor which allows the rod to be cooled in air as it passes along the conveyor. The rings are collected at the end of the conveyor and formed into coils.

8 Claims, 1 Drawing Figure

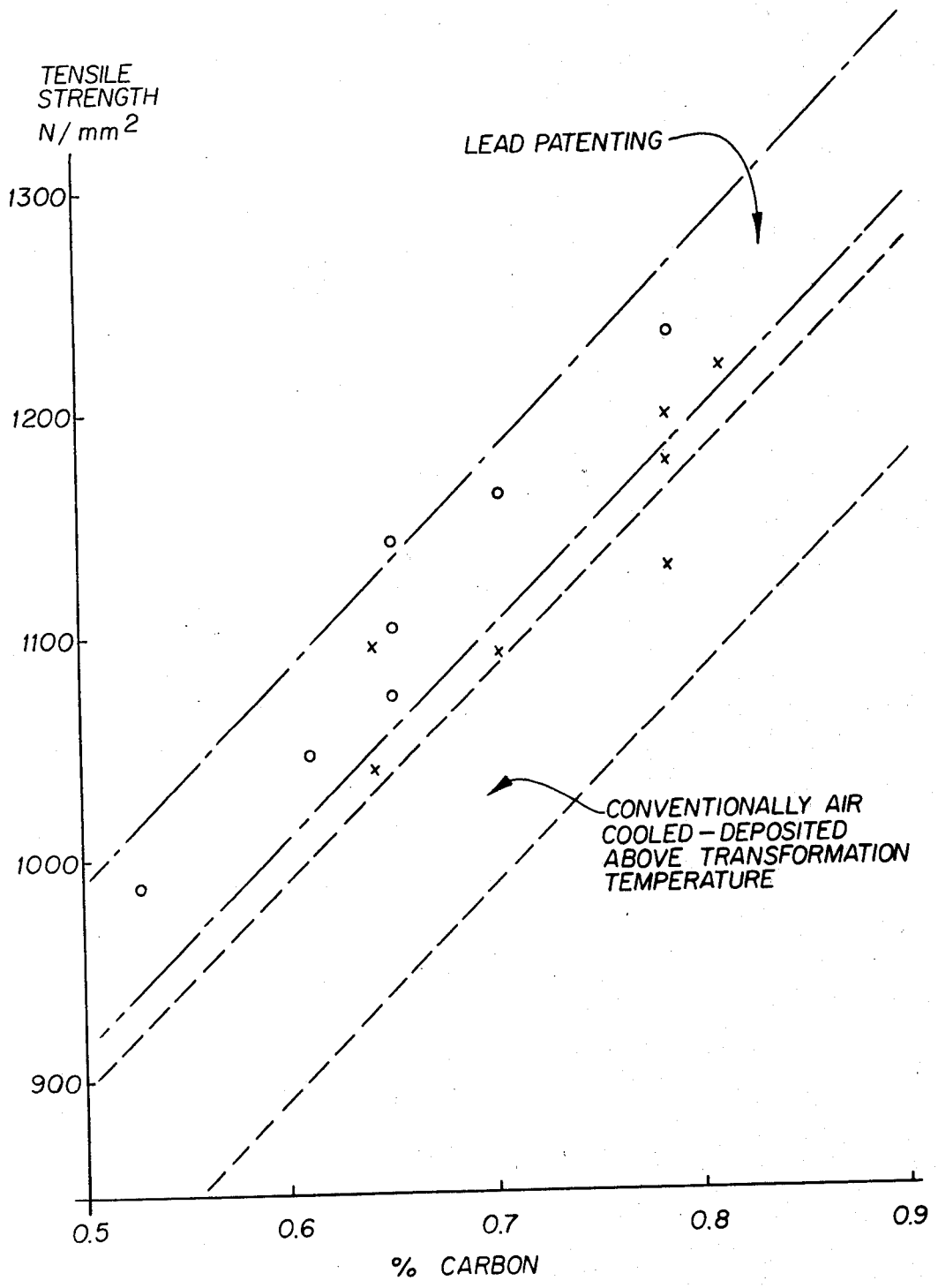
TENSILE STRENGTH N/mm2
1300
1200
1100
1000
900
LEAD PATENTING
CONVENTIONALLY AIR COOLED – DEPOSITED ABOVE TRANSFORMATION TEMPERATURE
0.5
0.6
0.7
0.8
0.9
% CARBON

MANUFACTURE OF STEEL PRODUCTS

This invention relates to the production of steel rod and is a continuation-in-part of our application No. 917,272 filed June 20, 1978, abandoned. In particular it is concerned with production of a high strength ductile steel rod in coil form.

It has been previously known to quench steel rod in water as it leaves the finishing stand of a continuous rod mill, and then to lay the rod in laps on an open continuous conveyor and to subject it to cooling by a forced draft of air as it passes along the conveyor. The rod is then formed into a coil as it leaves the conveyor. This process is generally known as the "Stelmor" controlled cooling system, and has as an essential objective, the production of rod with microstructures of ferrite and pearlite. In order to produce rod having these micorstructures, the rod is deposited on the moving conveyor at a temperature above that at which allotropic transformation of the austenite of the rod starts to occur.

According to one aspect of the present invention there is provided a process for producing hot rolled carbon-manganese steel rod having a manganese content of not more than about 0.78% including the steps of hot rolling the steel in a continuous rolling mill, the rod exiting from the last stand of the mill having a temperature in excess of 1000° C., superficially cooling the rod in water from a temperature of above 1000° C. to an equalisation temperature between 300° C. and 700° C., laying the rod on a moving conveyor so that the rod forms flat overlapping non-concentric rings, allowing the rod to be cooled in air as it passes along the conveyor and then collecting the non-concentric rings to form coils.

The cooling on the moving conveyor may be carried out in substantilaly still air. Alternatively, a certain amount of forced air cooling may be provided, particularly towards the end of the moving conveyor, to enable the coils to be satisfactorily handled thereafter.

The rod may consist of a carbon-manganese steel with a carbon content of between 0.05% and 1.00% and manganese between 0.4% and 0.9%. The steel may be produced in a balanced (semi-killed) or killed form although a suitable rimmed steel may also be employed.

The rod is preferably cooled in water to an equalisation temperature of between 400° C. and 700° C., although for steels at the lower end of the carbon range, or larger diameters, e.g. 15 mm, the equalisation temperature may need to be between 300° C. and 400° C.

The non-concentric rings may be reformed into coils at a temperature of at least 100° C. less than the temperature at which they are laid.

Rolling speeds of the order of 12,000 ft/minute (5.5 mm diameter), 8,000 ft/minute (9.5 mm diameter) and 3,500 ft/minute (15 mm diameter) may be obtained.

The process may include the step of forming ribs or indentations on the rod in the rolling process prior to cooling.

The cooled rod may be subsequently readily cold-drawn to form high strength wire, without the need for any intermediate heat treatment.

More particularly, however, this invention enables wire rod issuing from the mill to be used directly in a whole range of applications, e.g. wire mesh or wire fencing, without the need to carry out a subsequent drawing operation since the rod produced possesses the same strength as, but improved ductility levels of, conventional drawn wire, i.e. rod which has been subjected to further processing (drawing) after issuing from the mill. These property levels, furthermore, are obtainable with a composition having a much lower manganese content than is needed for material processed by drawing to produce similar properties.

The invention thus represents a considerable and beneficial advance in the art since a lower cost, higher grade material is obtained by this route.

The essence of the invention is the combination of the steps by which the rod is water cooled to an equalisation temperature below the level at which transformation occurs and then conveying it in flat overlapping rings so that it can be readily collected in coils for transportation. To do this the rod must be fairly ductile and of small diameter, thus the invention is directed to the use of rod below, say, 15 mm. Higher strength bar of larger diameters processed in the manner prescribed by this invention cannot be satisfactorily coiled.

Enhanced cooled steel rod in accordance with this invention utilised for reinforcement, for example, meets all the property requirements of hard drawn wire utilised for this purpose and can be produced on a commercial scale by a cheaper and much faster process route. For example, with reference to the U.S. standard specification for cold-drawn steel wire for concrete reinforcement ANSI/ASTM A 82-76 all size no's between W26 ( 15 mm) and W35 ( 5 nm) can be produced in rod of comparable or improved properties without the need for drawing into wire. Likewise, with regard to the tension test requirements in Table 1 (less severe than Table 2—welded fabric wire) the reduction of area to fracture—ductility—is much higher than the minimum value there stated (30%) and this we achieve with much higher strength levels in addition.

In one particular example of the operation of this process a mild steel rod including 0.25% carbon and 0.8% manganese issued through the last stand 15 mm in diameter at about 1050° C. The rod was rapidly quenched in water and laid on a moving conveyor at about 400° C. in the form of flat, overlapping non-concentric rings and then subjected to air cooling to temper the martensitic surface layer produced during the water quench. Subsequently the rod was taken up in the form of a coil and then cut to length. Tests conducted on the rod lengths gave tensile strength as 740 N/mm$^2$, 0.2% proof stress as 560 N/mm$^2$ and percentage reduction to fracture as 60.

A higher carbon rod (0.5%) of the same dimension was treated in the same fashion and gave a tensile strength of 1000 N/mm$^2$, 0.2% proof stress as 600 N/mm$^2$ and percentage reduction to fracture at 40.

Typical examples of steels treated according to the invention and the resultant properties of the rod thereby produced, are given in the following table. Rod diameters were between 5.5 mm and 9.5 mm.

| NO. | % C | % Mn | LAYING TEMP °C. | TENSILE STRENGTH N/mm$^2$ | 0.2% PROOF STRESS N/mm$^2$ | % REDUCTION OF AREA TO FRACTURE |
|---|---|---|---|---|---|---|
| 1 | 0.11 | 0.52 | 350 | 650 | 602 | 76 |
| 2 | 0.18 | 0.78 | 680 | 605 | 520 | 70 |
| 3 | 0.20 | 0.70 | 650 | 640 | 545 | 72 |
| 4 | 0.65 | 0.60 | 425 | 1090 | 650 | 50 |

-continued

| NO. | % C | % Mn | LAYING TEMP °C. | TENSILE STRENGTH N/mm² | 0.2% PROOF STRESS N/mm² | % REDUCTION OF AREA TO FRACTURE |
|---|---|---|---|---|---|---|
| 5 | 0.76 | 0.60 | 450 | 1160 | 675 | 48 |

In each of the examples it will be seen that the rod is cooled to below its transformation temperature before the commencement of laying. The finish rolling temperature in each example was approximately 1050° C.

The properties of the material produced by this process compare very favourably with similar steels treated by the known controlled cooling system above referred to in which the rod is deposited at a temperature above that at which transformation occurs. For example, the steel shown in example 1 when treated in this know manner would normally have a tensile strength of about 485 N/mm²and a yield strength of about 375 N/mm² The steel of example 4 when treated in this known manner would have a tensile strength of about 920 N/mm² and a 0.2% Proof Stress of 545 N/mm².

Furthermore, additional results are depicted in the enclosed drawing which graphically illustrates the tensile strength levels attained with various carbon compositions for both 5.5 mm diameter rod (shown with the 'dot' indicia) and 9.5 mm diameter rod (shown with 'star' indicia) processed in accordance with this invention. Manganese levels were between 0.4% and 0.9%, the reduction of area to fracture being between 50% and 60% for the smaller diameter rod and between 40% and 62% for the 9.5 mm diameter rod.

For comparison purposes, superimposed on the graph are two bands illustrating the tensile strengths (with carbon) obtained by processing 5.5 mm to 8.5 mm diameter rod, the lower band being in accordance with the known process identified above and the upper band being in accordance with a lead patenting process in which the overlapping looped rod is submerged and cooled in a lead bath at about 500° C. The results which we obtain are roughly comparable to those obtained by the latter process which is much more expensive and complex, and slower, than that according to the present invention.

Whereas, as mentioned, rod issuing from the mill may be used directly it is nevertheless capable of substantial cold drawing without further heat treatment to produce high strength wire. Alternatively, an enhancement of conventional wire strengths can be obtained by less drawing than is required with conventional rod, thereby considerably reducing the cost to the customer. At the lower carbon values, high strength fencing wire and roping can be produced more cheaply, and at the higher carbon levels, say above 0.50% carbon, spring steel wire can be produced very economically. The rod has high ductility, with typical elongation values of 17 to 21% which enables a relatively high degree of cold drawing to be carried out without the need for heat treatment.

We claim:

1. A process for producing hot rolled semi-killed or killed carbon-manganese steel rod having a manganese content of not more than about 0.8% including the steps of hot rolling the steel in a continuous rolling mill, the rod exiting from the last stand of the mill having a temperature in excess of 1000° C., superficially cooling the rod in water from a temperature of above 1000° C. to an equalisation temperature of between 300° C. and 700° C., to produce a martensitic surface layer, laying the rod on a moving conveyor so that the rod forms flat overlapping non-concentric rings, allowing the rod to be cooled in air as it passes along the conveyor and then collecting the non-concentric rings to form coils.

2. A process according to claim 1 in which the rod is substantially cooled in water to a n equalisation temperature of between 400° C. and 700° C.

3. A process according to claim 1 or claim 2 in which the rod is cooled on the moving conveyor in substantially still air.

4. A process according to claim 1 in which the rod consists of a carbon-manganese steel with a carbon content of between 0.05% and 1.00%.

5. A process according to claim 4 in which the carbon content of the rod is between 0.08% and 1.00%.

6. A process according to claim 1 in which the non-concentric rings are re-formed into coils at a temperature of at least 100° C. less than the temperature at which they were laid.

7. A process according to claim 1 in which projections are formed on the rod inthe rolling process prior to cooling.

8. A process according to claim 1 in which the cooled rod is subsequently cold-drawn without any intermediate heat treatment to form wire.

* * * * *